US008561695B2

(12) United States Patent
Cameron et al.

(10) Patent No.: US 8,561,695 B2
(45) Date of Patent: Oct. 22, 2013

(54) APPARATUS AND METHOD FOR TESTING SOLIDS PRODUCTION IN A WELLBORE

(75) Inventors: John Alasdair MacDonald Cameron, The Woodlands, TX (US); Peng L. Ray, Spring, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 253 days.

(21) Appl. No.: 13/084,028

(22) Filed: Apr. 11, 2011

(65) Prior Publication Data

US 2012/0255727 A1 Oct. 11, 2012

(51) Int. Cl.
*E21B 47/00* (2012.01)

(52) U.S. Cl.
USPC ..... 166/250.01; 166/264; 166/227; 166/144

(58) Field of Classification Search
USPC ..... 166/250.01, 107, 179, 144, 227, 243, 166/264, 386, 106, 297, 55
See application file for complete search history.

(56) References Cited

U.S. PATENT DOCUMENTS 3,913,676 A * 10/1975 Barbee et al. ..... 166/278
2011/0241897 A1* 10/2011 Haynes et al. ..... 340/854.5

OTHER PUBLICATIONS

"MDT Modular Formation Dynamics Tester", Schlumberger brochure, SMP-5124, Jun. 2002, 11 pages.
Schlumberger brochure "MDT Modular Formation Dynamics Tester, Quality fluid samples and highly accurate reservoir pressures," SMP-5124, Jun. 2002, 11 pages.

* cited by examiner

*Primary Examiner* — Yong-Suk (Philip) Ro
(74) *Attorney, Agent, or Firm* — John Vick

(57) ABSTRACT

An apparatus and method is disclosed for conducting a fluid and solids production test in a subterranean well. A testing apparatus may be inserted into a wellbore. The apparatus may employ a tubular housing with entry port(s) through the housing. An inner assembly may be positioned within the tubular housing, the inner assembly being configured for connection to the tubular housing. The inner assembly may include a fluid permeable screen and a distal end forming a reservoir that is scaled, or may be adapted to be scaled, for the collection of solids during a well production testing event. Following a testing event, the apparatus may be removed from the wellbore to enable the collected solids to be measured to determine the amount of solids generated by a subterranean formation at actual field flow conditions.

3 Claims, 3 Drawing Sheets

APPARATUS AND METHOD FOR TESTING SOLIDS PRODUCTION IN A WELLBORE

FIELD OF THE INVENTION

The invention is directed to an apparatus and method for capturing produced solids and measuring the sanding propensity of a subterranean formation penetrated by a wellbore.

BACKGROUND

In the oil and gas industry, hydrocarbons are produced from underground formations. In some hydrocarbon-bearing formations, such as sandstone formations, solids may be produced with the hydrocarbons. Production of solids with hydrocarbons is undesirable for many reasons. Fluids containing solids generally are much more erosive, and may damage metallic conduits and pipe in the wellbore and in the surface oil and gas processing equipment. Excess production of solids may plug or block the wellbore, or inhibit flow of fluids through processing equipment. When this occurs, it may require costly wellbore or surface facility cleanout operations before hydrocarbon production may resume.

It is known that solids production varies considerably in different subterranean formations. Solids generally consist of sand (quartz) particles but may also contain other natural or deposited materials such as clays, silts, salts, feldspars, and the like. When completing a well, it is desirable to determine if the well is likely to produce solids with the hydrocarbons. If solids production is likely, then sand or solids production control measures may need to be implemented. Such solids production inhibition methods may include, for example, fracturing and packing the fractured reservoir with sand, gravel or proppant to inhibit further solids production. It may be desirable to install chemical inhibition, consolidation or mechanical screen assemblies in the wellbore. There are many different techniques and equipment available to inhibit solids production. However, solids production control methods must be designed and appropriate for a given wellbore, and the appropriate method may depend upon the depth, pressure, temperature, and other conditions of hydrocarbon production. The implementation of solids production control techniques and installation of solids control apparatus is generally time consuming and costly, as is the addition of surface solids handling and treatment equipment. Further, the requirement to install such equipment reduces the commercial viability of many projects.

The pressure differential between the wellbore and the subterranean formation is an important factor in determining how much solids will be produced. It is desirable, for a given wellbore, to understand the downhole conditions at which the onset of solids production will occur and the volume of solids that can be expected to be produced. By understanding solids production characteristics of a wellbore, it is possible to tailor a solids production control strategy that is likely to prove successful for the least amount of effort and cost.

Solid particles are generally denser than fluids in water and hydrocarbon wellbores. During well tests and in production mode, wellbore fluids need to travel faster than a specific rate to lift solid particles to the surface. Once fluid production is stopped in a typical well test, the solids in the produced fluid settle in the wellbore. Heavier solid particles will settle faster than lighter particles and therefore require a higher fluid velocity to lift them to the surface. Settling of solids in the wellbore presents operational problems, including for example the risk of a stuck drill pipe in subsequent operations. Solids settling velocities also mean that surface samples are an unreliable measure of the total produced solids.

This invention is directed to apparatus and methods for determining or measuring solids production characteristics for a subterranean formation penetrated by a wellbore, while avoiding some of the problems inherent in capturing the solids at surface.

SUMMARY OF THE INVENTION

The invention is directed to an apparatus and method for conducting a solids production test in a subterranean well. The apparatus includes a tubular housing with a proximal end and a closed distal end. The housing has one or more entry ports on its exterior surface, the entry ports passing through the thickness of the housing and positioned between the proximal and distal ends of the housing. An attachment mechanism is positioned on the proximal end of the tubular housing and configured to suspend the tubular housing within a wellbore.

An inner assembly is positioned within the tubular housing. The inner assembly includes a proximal end and a distal end. The inner assembly is configured for connection to the tubular housing. The inner assembly includes a fluid permeable screen designed to facilitate fluid flow but retard passage of solids through the screen. The inner assembly may be sealed at its distal end. An annular space is provided between the inner assembly and the tubular housing. The apparatus is configured for receiving a flow of production fluids and solids through the entry ports into the annular space.

The distal end of the tubular housing may include a reservoir adapted for receiving and storing solids for subsequent analysis. The reservoir may be comprised of several separate catchment volumes, or catchment compartments. A first catchment compartment includes at least one barrier. The barrier is capable of manipulation from an open position to a closed position to seal off the first catchment compartment. The first catchment compartment is configured to receive and store solids received in the first phase of the solids production test or tests.

A second catchment compartment is positioned proximally (above as shown in the Figures) of the first catchment compartment. The second catchment compartment is configured for receiving solids through its interior space to the first catchment compartment during a first solids production test phase. The second catchment compartment is adapted for receiving and storing solids produced during a second solids production test phase.

In one embodiment of the invention, the distal end of the inner assembly comprises an aperture configured to receive a plug. The distal end of the inner assembly may be sealed by the plug, which can be run into the wellbore by wireline. In some instances, a well test for fluid pressure and/or sampling is run without solids capture, and then the plug is set in the distal end of the inner assembly, as further discussed herein.

Typically, the inner assembly also includes a screen. The fluid may proceed from the annulus through the screen of the inner assembly. Solids produced from the subterranean well may be deposited in the reservoir. In some embodiments of the invention, the distal end of the inner assembly is permanently sealed. In other applications, the distal end of the inner assembly comprises a valve or plug. The proximal end of the tubular housing may be configured for location in or connection to a packer. The inner assembly also may include a fluid pressure gauge with the ability to store fluid pressure in memory for later retrieval, or may be configured for real time readout by the well operator during the testing. Various detectors, including a solids particle detector, also may be provided upon the inner assembly.

Wiper seals may be positioned on the exterior surface of the tubular housing. The wiper seals may be provided in intimate contact with the exterior of the tubular housing, and may serve as a barrier to unwanted fluid flow below the level of the test apparatus in the annular space outside of the apparatus. The distal end of the tubular housing also may be configured for connection to a perforating gun. In some instances in cased hole for example, a perforating step may be performed, followed by a test of the perforation using the apparatus of the invention.

If operating in an uncased open-hole, perforation or stimulation may not be required. Alternatively, perforating in a cased wellbore may be performed as a separate activity or may already be extant if the test is performed in an older well. The testing apparatus may be lowered into the wellbore adjacent a subterranean formation. Then, the surface pressure may be reduced to induce a first flow rate. This causes formation fluids and solids to flow from the subterranean formation through the entry ports and into the annular space of the testing apparatus. Then, formation fluids are passed through the fluid permeable screen into the inner assembly. Solids are prevented from passing through the fluid permeable screen, and are collected in a reservoir below the screen, as further shown in the Figures. Once solids have been collected for a particular test condition or flow pressure, the apparatus may be removed from the wellbore, and the solids may be characterized as to the quantity produced and the particle size distribution.

The reservoir of the testing apparatus may include a first catchment compartment with a barrier. The barrier may be capable of manipulation from an open position to a closed position to seal off the first catchment compartment, further wherein the first catchment compartment is configured to receive and store solids. Further, a barrier or door may be provided for closure in the upper portion of the first catchment compartment, forming a floor in the second catchment compartment. A second, third, fourth, fifth, or additional compartment may be employed, with corresponding barriers. Numerous such compartments may be used to collect samples corresponding to reservoir tests at different pressures or conditions.

The reservoir of the testing apparatus also may include a second catchment compartment. In some cases, a second flow test or test phase is conducted by adjusting the pressure in the testing apparatus to increase the flow rate of formation fluids and solids to a higher second flow rate. Then, and prior to the rate increase, the barrier of the first catchment compartment may be closed. Formation fluids may be passed through the fluid permeable screen into the inner assembly. Solids are blocked from passing through the fluid permeable screen, and are collected in the second catchment compartment. Further, a barrier may be provided for closure in the upper portion of the second catchment compartment, forming a seal for the second catchment compartment and a floor for a third catchment compartment, if a third catchment compartment is employed. Additional catchment compartments could be employed as well.

More than two or three catchment compartments may be included in the apparatus. A practical limit however would be determined by the length and service life of the sand screen employed, the time taken to perform the number of test phases, and the barrier actuation mechanisms and signaling requirements.

Once solids are collected, the testing apparatus may be removed from the wellbore. Solids in the catchment compartments then may be weighed, measured and analyzed.

In some embodiments of the invention, the inner assembly also includes various detectors, including (for example) pressure, temperature, dielectric, fluid flow rate and solids detection. In such embodiments, the method may also include an observation of the pressure, water cut and flow rate at which solids first begin to contact the solids detector. It is possible to measure the amount of solids entrained in the fluid flow with respect to rate and time.

The method may be practiced by employing upon the inner assembly a solids detector and a pressure gauge. Further, it is feasible to measure the pressure at which solids first begin to contact the detector. The method may also include determining whether the solids flow is transient or continuous. It may be possible to measure the total quantity of solids in the flowing formation fluids. Also, it may be possible to measure flow rates, fluid composition, time and pressure. It also may be useful to measure a representative sample of solids directly produced from a flowing perforation or an open-hole interval. In all instances, it will be useful to calibrate or verify the total quantity of solids produced at the end of each known flow rate or test phase. The invention, in one embodiment, makes it possible to calibrate and verify proprietary and industry solids production prediction models us well.

BRIEF DESCRIPTION OF THE FIGURES

The various aspects of the invention may be observed by reference to one or more Figures as follows. However, the scope of the invention is not limited to embodiments disclosed in the Figures.

DETAILED DESCRIPTION OF THE INVENTION

Figure 1:
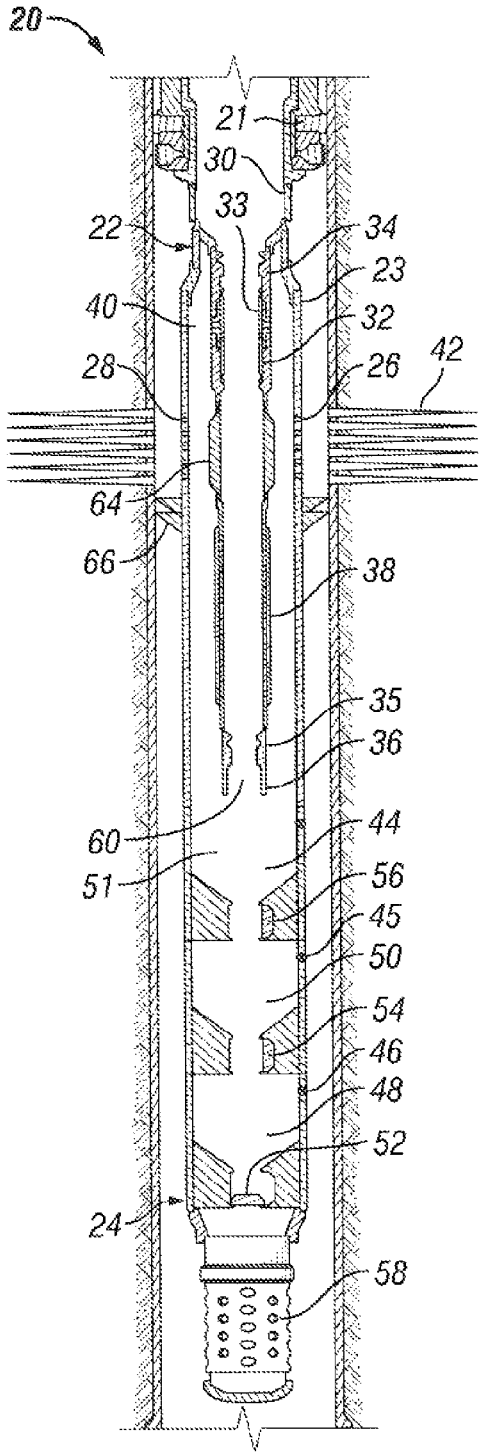
FIG. 1 shows a well test string apparatus within a cased wellbore in which the apparatus is positioned adjacent perforations in the subterranean well.

The design of well tests in exploratory and appraisal wells sometimes is made more difficult because key factors such as production rate, drawdown and produced solids quantity are largely unknown or uncertain. For example, it is typically not known the quantity of solids that will be produced by the first well drilled in a new region or field. The amount of solids production is very important in determining the design and completion configuration for wells drilled in that field.

In general, the amount of solids, the properties of the sandstone, the fluid type and viscosity, the fluid production rate, the solids particle size distribution, and other factors may contribute to the determination of the quantity of solids likely to be entrained in the fluid and produced to the surface during well production and testing. Once solids are produced into the wellbore, such solids desirably will be lifted to the surface to prevent downhole tools from becoming lodged in the wellbore. If the production flow is not sufficient, all or part of the solids may not be lifted to the surface. Heavier particles require more flow rate than lighter particles to reach the surface.

Surface sampling therefore is not preferred, as it can present an unreliable measure of the total produced solids. Additionally, conventional sand samples are obtained from full or side-wall formation coring operations. These samples do not fully represent the actual solids that might be produced from the perforations as the formation starts to produce solids. However, the application of this invention provides a new and improved apparatus and method for making onset and volume estimates of solids production in a well and for capturing a more representative sample of produced solids impacting a future sand control installation.

Solids are produced when a sandstone (or other solid in the formation) begins to fail or already has failed mechanically due to diminishing reservoir pressure. In that instance, the fluid flow conditions enable the entrainment of the loosely attached solids particles. To test a formation, it may be necessary to cause the structure of the sandstone to fail. Facilitating the physical failure of the rock in reservoirs that have never produced hydrocarbons may require a relatively high drawdown pressure. Facilitating high drawdown pressures may require in turn the use of surface or downhole lift or pumping systems that are not compatible with solids production. For example, excessive solids may clog or damage electrical submersible pumps.

Testing formations for solids production often is omitted or avoided in many well appraisal programs, which is undesirable. One advantage of the testing apparatus and method of this invention is that many of the uncertainties of sanding test design may be avoided by allowing lift or pump systems to apply high drawdown pressures directly to the subterranean formation, allowing for subsequent collection of a representative sample of the produced solids for analysis.

Figure 2:
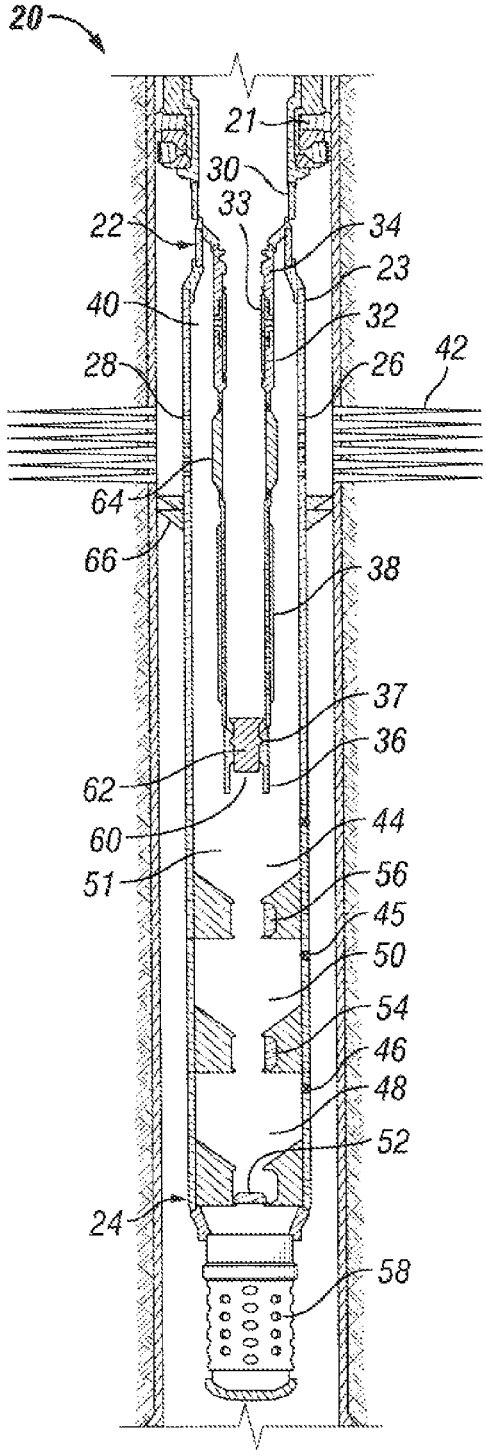
FIG. 2 illustrates the apparatus of FIG. 1 in which a plug has been run in the well on wireline and engaged to the distal end of the inner assembly to seal the inner assembly.
Figure 3:
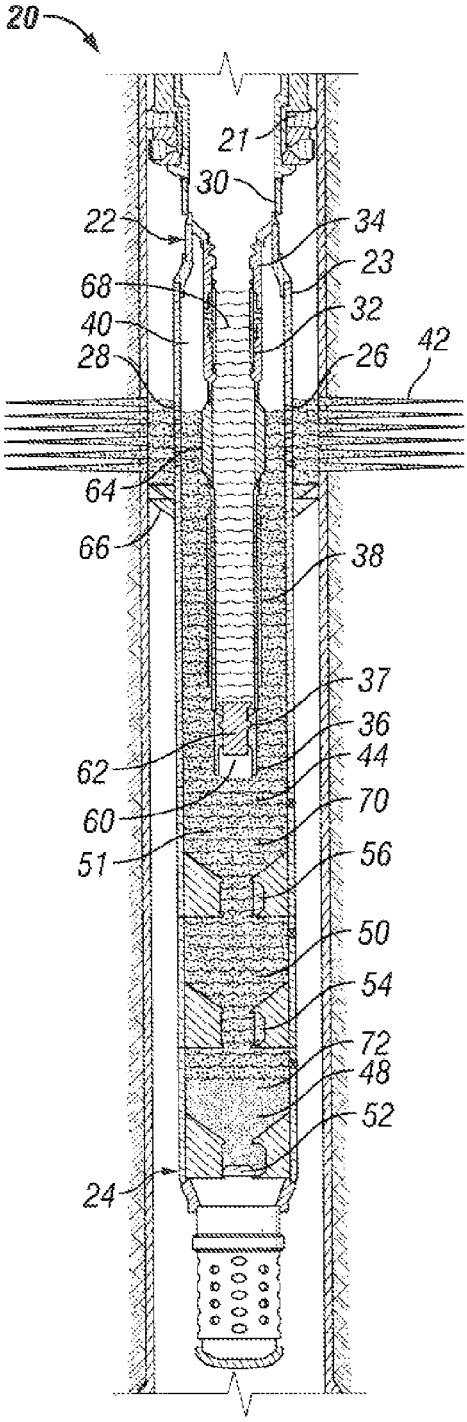
FIG. 3 shows the apparatus of FIGS. 1-2 during a sanding test, wherein formation fluid containing solids are produced into the apparatus and collected in a first (lower) catchment compartment of the reservoir.
Figure 4:
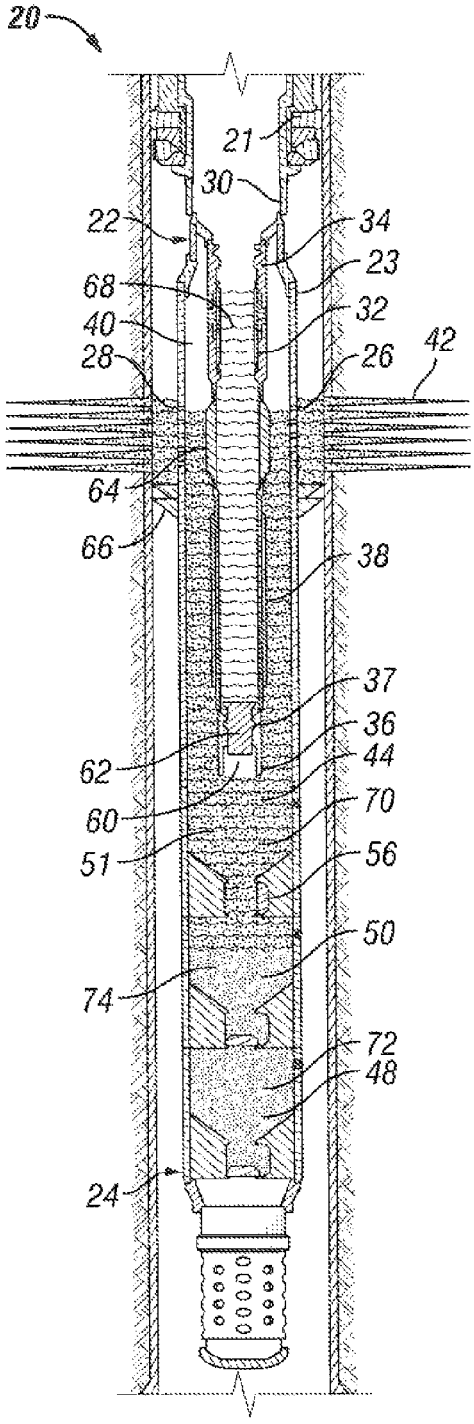
FIG. 4 shows a later stage of the sanding test, conducted at a different pressure, at a later point in time, in which solids from this subsequent test is collected in a second catchment compartment.

In FIG. 1, an apparatus 20 is shown suspended from a hanger or packer 21. A ported tubular housing 23 comprises a proximal end 22 and a distal end 24. Entry ports 26, 28 (as examples) are provided through the housing, which provides an entry point for formation fluid and sand. Several entry ports in addition to entry ports 26, 28 may be provided for fluid entry into the apparatus 20, depending upon the configuration of the apparatus 20. An attachment mechanism 30 is provided for secure and releasable connection of apparatus 20 to packer 21. An inner assembly 32 is fixed or located in an nipple (not shown) on the inside of the tubular housing 23. Inner assembly 32 is provided with a proximal end 34 and a distal end 36 (distal end shown open in FIG. 1). The distal end 36 of the inner assembly includes a nipple cavity 35 which is designed to receive in locking engagement nipple 37 of plug 62 (plug 62 is shown in FIGS. 2-4). The inner assembly 32 may be provided with a sliding sleeve 33 and with a fluid permeable screen 38 that facilitates fluid flow into the apparatus 20, but retards solids movement into apparatus 20. The sliding sleeve 33 permits fluid entry later if the screen becomes clogged with solids. The entire inner assembly 32 can be removed separately during the test if the screen becomes clogged or solids are not expected. An annular space 40 is a circular "donut-shaped" cavity that exists outside of the inner assembly 32, and is bounded by the inner surface of tubular housing 23. Relief valves 45, 46 are provided in each compartment if the compartment barriers 52, 54, 56 are pressure sealing. The compartment barriers 52, 54, 56 may be designed to be either only solids tight, i.e. prevent solids from passing, or may be pressure tight to obtain a fluid sample.

Perforations 42 are shown in the subterranean formation. These perforations facilitate the flow of oil and gas from the formation to the apparatus 20. Near the distal end 24 of the tubular housing, a reservoir 44 is provided. The reservoir 44 receives sand, as will be further discussed herein. In the first embodiment of the invention, as shown in FIGS. 1-4, the reservoir 44 comprises a first catchment compartment 48 and a second catchment compartment 50. A third potential catchment compartment 51 also is shown, and may be employed. A barrier 52 is provided, which may be engaged or closed to isolate the lower portion of first catchment compartment 48, just prior to entry of solids into reservoir 44. This permits access to the firing head and perforating guns below for example and if required. A barrier 54 is capable of movement between an open and a closed position. Barrier 54 may be engaged (closed) to capture collected solids in first catchment compartment 48, as further discussed herein. Barrier 56 likewise may be engaged/closed to capture solids collected in second catchment compartment 50. Barrier 56 also forms the floor for third catchment compartment 51.

Barriers 52, 54, 56 may consist of either a plug that may be dropped or installed by wire-line or coil tubing, or applied in another type of sealing arrangement. The seal may be only solids tight or may be pressure sealing. If pressure sealing, a relief mechanism (not shown) likely would be included in the catchment compartment design. The barriers 52, 54 and 56 may either be installed by wire-line or coiled tubing or be actuated remotely using control lines, timing, pressure or acoustic pulses or another such system available in the industry.

A firing head and perforating gun 58 is suspended from the distal end 24 of the tubular housing 23. In the operation of apparatus 20, the apparatus may be positioned so that the perforating gun 58 is opposite the portion of the subterranean formation 42 to be perforated. Once perforation is completed, the apparatus may be lowered into a position similar to that shown in FIGS. 1-4 for sanding tests.

An aperture 60 is provided in the distal end 36 of the inner assembly 32. Nipple cavity 35 mates with nipple 37 of plug 62. Plug 62 may be run into the wellbore on a wireline, as further discussed herein, and seated by interaction of nipple 37 with nipple cavity 35.

A detector package incorporating for example a solids particle detector 64 also may be provided in association with the inner assembly 32. The solids detector 64 (if acoustic in nature) may be partially encased in an elastomer to dampen the particle impacts if required. The drill string may be positioned in the well so that the inner assembly 32 and its solids particle detector 64 is provided opposite perforations of that portion of the formation that is to be tested for solids production. The pressure may be monitored and readings stored in memory, or provided to the surface for real time readout, using techniques known in the industry. The solids may be detected by its physical contact with solids detector 64, so that the onset and amount of solids production may be monitored by way of data capture or in real time during the testing.

Wiper seal 66 may be provided circumferentially around the outside of tubular housing 23. In this manner, fluids entering the wellbore are bounded on top by the packer 21 and on below by wiper seals 66, such that the fluids will not escape but desirably will be produced through the entry ports 26, 28 into the apparatus 20.

FIG. 2 shows the apparatus of claim 1, in which plug 62 has been seated in the distal end 36 of inner assembly 32. Further, barrier 52 has been closed for the sanding test, as shown in FIG. 2. The various methods of actuating these barriers 52, 54, 56 can be either remotely via hydraulic or electrical control lines, by timing and pressure pulses to powered/battery operated devices, by electromagnetic or acoustic pulses through the work string to battery operated devices, physically using wire-line or coiled tubing plugs, or any such other method as is available in the industry.

A sanding test is conducted as shown in FIG. 2. Production fluid 68 passes through entry ports 26, 28 into inner assembly 32. Solids enter through entry ports 26, 28 as well, and impact on the detector 64. Such detector 64 may be operated by way of fiber optics or other means, and such devices are known and available in the industry. Solids 70 are prevented from traveling to the surface with fluid 68 by the solids screen 38, and instead settle into first catchment compartment 48 as deposited solids 72. The first catchment compartment 48 seals when required either actuated remotely or at a predetermined or set time and pressure by way of plug or barrier 54 closing to form a seal.

Next, a high rate or larger drawdown pressure step may commence, in which the pressure is raised and solids again are allowed to enter and are collected in the second catchment compartment 50, shown in FIG. 4. Deposited solids 74 may be collected second catchment compartment 50.

Figure 5:
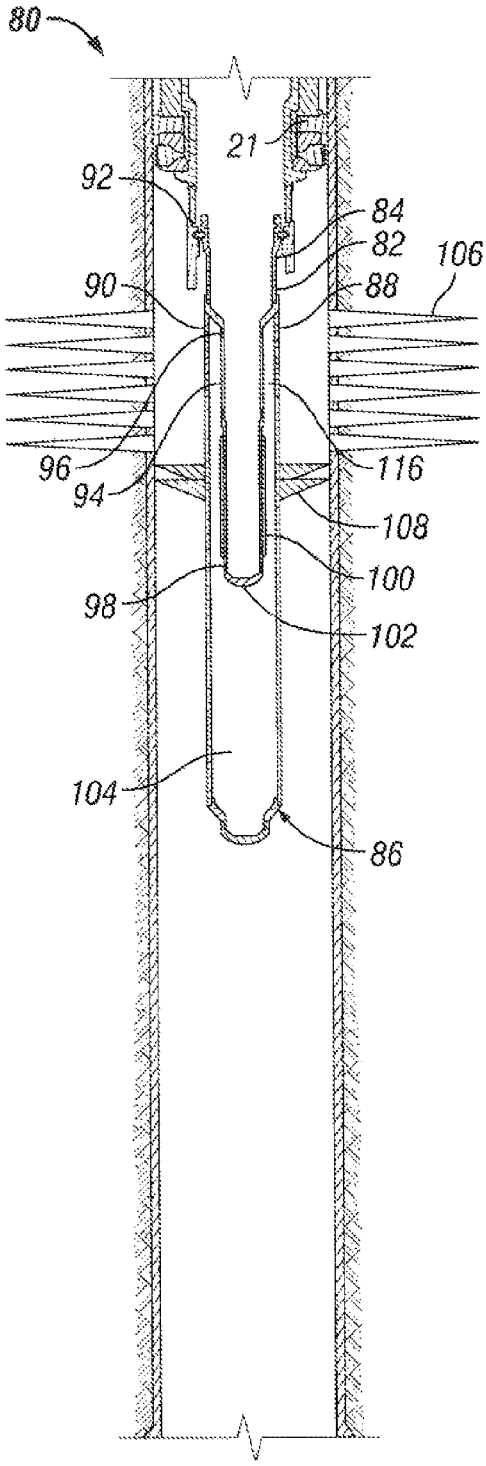
FIG. 5 illustrates a second embodiment of the invention in which an apparatus is run into the well on wireline and landed into place below a packer.
Figure 6:
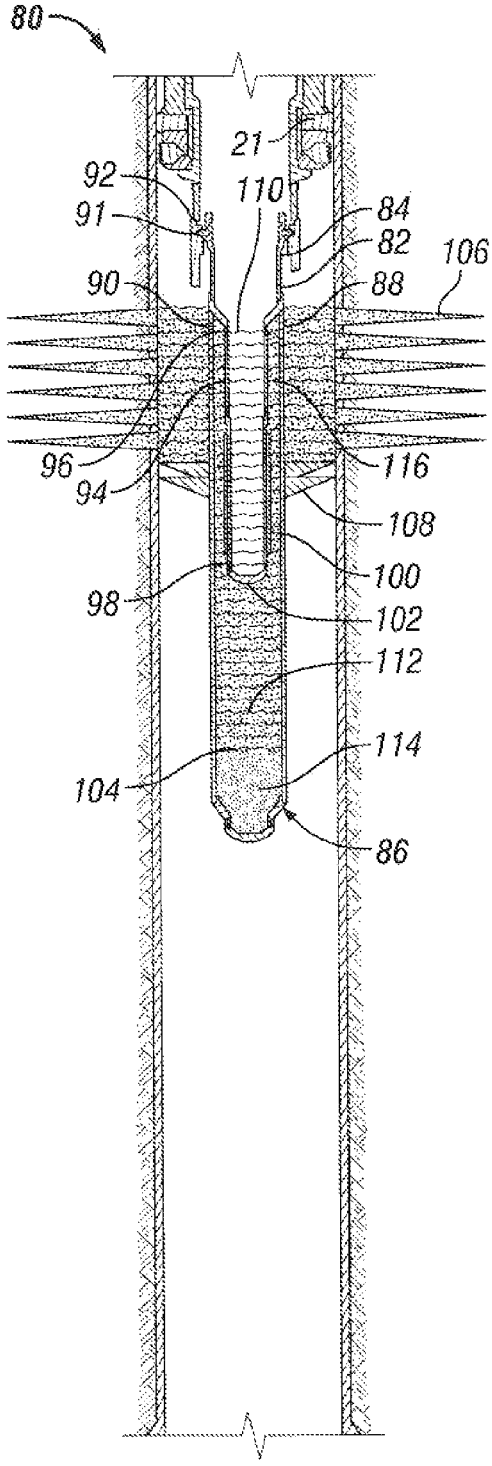
FIG. 6 shows the second embodiment (same apparatus as shown in FIG. 5) during a sanding test in which fluid and solids produced from the formation enter the apparatus and solids are collected in the sealed distal end of the tubular housing.

A second embodiment of the invention is illustrated in FIGS. 5-6. Apparatus 80 is suspended in a wellbore from packer 21. A tubular housing 82 comprises proximal end 84 and distal end 86. Entry ports may be numerous, as may be seen for example as entry ports 88 and 90. A nipple 91 is provided on the proximal end of tubular housing 82 to facilitate engagement with a corresponding void in attachment mechanism 92. This attachment mechanism 92 facilitates the remote "locking" of the apparatus 80, as when it is lowered into the well by way of wireline for installation below a packer 21 for a testing event.

Inner assembly 94 includes a proximal end 96 and a distal end 98. The distal end 98 is sealed at cap 102. Fluids from perforations 106 flow into entry ports 88, 90 and through screen 100 into the apparatus 80. Wiper seal 108 forms a fluid boundary below the perforations 106, while packer 21 forms an upper boundary. In this manner, it is possible to isolate a section of well for fluid movement which facilitates pressure drawdown.

The second embodiment of the invention, as shown for example in FIG. 5, may facilitate the apparatus 80 to be run into the wellbore with perforating guns and detectors attached, in another alternative configuration (not shown in the Figures).

An apparatus 80 that is conducting a sanding test is shown in FIG. 6, wherein solids 112 enter with fluid 110 to the annular space 116, with solids 112 falling downward while fluid 110 passes through screen 100 to the interior of the inner assembly 94 for production up the well. Reservoir 104 collects deposited solids 114, which may subsequently be measured for quantity and/or analyzed for particle size distribution of solid particles.

In the second embodiment of the invention, as seen in FIGS. 5-6, the entire apparatus 80 with tubular housing 82 and inner assembly 94 may be retrieved to the surface by a wireline or coiled tubing string once the sanding test is completed.

The invention is shown by example in the illustrated embodiments. However, it is recognized that other embodiments of the invention having a different configuration but achieving the same or similar result are within the scope and spirit of the invention.

What is claimed is:

1. An apparatus adapted for conducting a solids production test in a subterranean well, the apparatus comprising:

(a) a tubular housing with a proximal end and a closed distal end, the housing having entry ports on an exterior surface, the entry ports passing through the housing and being positioned between the proximal and distal ends of the housing;

(b) an attachment mechanism positioned on the proximal end of the tubular housing and configured to suspend the tubular housing within a wellbore;

(c) an inner assembly, the inner assembly being positioned within the tubular housing, the inner assembly having a proximal end and a distal end, the proximal end of the inner assembly being configured for connection to the tubular housing, the inner assembly further comprising a fluid permeable screen, wherein the inner assembly is adapted for being sealed at the distal end;

(d) an annular space between the inner assembly and the tubular housing; and (e) the apparatus being configured for receiving a flow of production fluids and solids through the entry ports and into the annular space, further wherein the distal end of the tubular housing comprises a reservoir adapted for receiving and storing solids for subsequent analysis;

(f) the reservoir comprising a first catchment compartment associated with the distal end of the tubular housing, the first catchment compartment having at least one barrier, the barrier being adapted for manipulation from an open position to a closed position to seal the first catchment compartment, further wherein the first catchment compartment is configured to receive and store solids received in a first solids production test;

(g) a second catchment compartment positioned proximally of the first catchment compartment, the second catchment compartment being configured for receiving solids through an interior space to the first catchment compartment during a first solids production test, further wherein the second catchment compartment is adapted for receiving and storing solids produced during a second production test.

2. A method for testing a wellbore, the wellbore penetrating a subterranean formation, the method comprising;

(a) providing a testing apparatus comprising:

(i) a tubular housing with at least one entry port through the housing and a reservoir configured for collecting sand, wherein the reservoir of the testing apparatus comprises a first catchment compartment, the first catchment compartment having a barrier, the barrier being adapted for manipulation from an open position to a closed position to seal the first catchment compartment, further wherein the first catchment compartment is configured to receive and store sand, the housing further providing a second catchment compartment configured to receive and store sand;

(ii) an inner assembly inside the tubular housing, wherein an annular space is provided between the inner assembly and the tubular housing, the inner assembly further comprising at least one fluid permeable screen; and (b) lowering the testing apparatus into the wellbore adjacent a subterranean formation;

(c) adjusting pressure in the testing apparatus to a first flow rate to cause formation fluids and solids to flow from the subterranean formation through the entry port and into the annular space of the testing apparatus:

(d) passing formation fluids through the fluid permeable screen into the inner assembly;

(e) inhibiting passage of solids through the fluid permeable screen;

(f) collecting solids in the reservoir for analysis;

(g) subsequently adjusting the pressure in the testing apparatus to increase the flow rate of formation fluids and solids to a higher second flow rate, (h) closing the barrier of the first catchment compartment, (i) passing formation fluids through the fluid permeable screen into the inner assembly, (j) inhibiting passage of solids through the fluid permeable screen, and (k) collecting, for analysis, solids in the second catchment compartment.

3. The method of claim 2 further comprising the additional steps of:

(l) removing the testing apparatus from the wellbore;

(m) characterizing the collected solids.

* * * * *